United States Patent [19]

Ellers

[11] Patent Number: 4,935,077

[45] Date of Patent: Jun. 19, 1990

[54] PROCESS FOR BONDING CELLULOSIC NONWOVENS WITH THERMOPLASTIC FIBERS USING INFRARED RADIATION

[75] Inventor: Berne Ellers, Örkelljunga, Sweden

[73] Assignee: Hercules Incorporated, Wilmington, Del.

[21] Appl. No.: 138,214

[22] Filed: Dec. 28, 1987

[30] Foreign Application Priority Data

Jan. 9, 1987 [SE] Sweden ..... 8700060

[51] Int. Cl.[5] ..... B32B 31/20; B32B 31/26

[52] U.S. Cl. ..... 156/62.6; 34/4; 34/16; 34/23; 34/26; 34/34; 34/41; 156/272.2; 156/285; 156/296; 156/308.2

[58] Field of Search ..... 156/62.2, 62.6, 62.4, 156/62.8, 285, 296, 161, 308.2, 497, 272.2, 275.1, 286, 275.7, 308.4, 308.6, 309.6, 380.9; 250/492.1; 34/4, 16, 23, 26, 29, 34, 41, 68; 264/119, 126; 219/388, 354, 243

[56] References Cited

U.S. PATENT DOCUMENTS

| | | | |
|---|---|---|---|
| 3,340,617 | 9/1967 | Carroll, Jr. | 34/41 |
| 3,357,878 | 12/1967 | Newman | 156/62.6 |
| 3,619,322 | 11/1971 | Fleissner | 156/62.2 |
| 3,861,057 | 1/1975 | Wittstock | 156/359 |
| 3,864,546 | 2/1975 | Cahnman | 34/48 |
| 3,908,250 | 9/1975 | Agan | 34/41 |
| 4,105,484 | 8/1978 | Newton et al. . | |
| 4,169,007 | 9/1979 | Pray | 156/359 |
| 4,324,752 | 4/1982 | Newton et al. . | |

FOREIGN PATENT DOCUMENTS

| | | |
|---|---|---|
| B509757 | 4/1980 | Australia . |
| 2218077 | 10/1973 | Fed. Rep. of Germany . |
| 199787 | 11/1965 | Sweden . |

OTHER PUBLICATIONS

"Vliesstoffe", Joachim Lunenschloss and Wilhelm Albrecht, Georg Thieme Verlag Stuttgart, New York, 1982, pp. 218–219.

*Primary Examiner*—Merrell C. Cashion, Jr.
*Attorney, Agent, or Firm*—Connolly and Hutz

[57] ABSTRACT

A method and apparatus are disclosed for binding a nonwoven material by means of a binding agent requiring heat for activation, particularly for binding cellulosic fibers with a thermoplastic material. The material is irradiated with an infrared radiation source, and surface burning of the irradiated material is prevented by passing a weak flow of air through the material. Inclined walls guide the air flow through the material in an inclined path directed from the edge of the infrared radiation source and towards the center thereof. Each infrared radiation source is surrounded by two side walls so that a space is formed between each side wall and the radiation source for the passage of the inlet air. The cross-sectional areas of these spaces are together approximately equal to the cross-sectional area of a suction channel positioned opposite the spaces. The air flow is controlled by means of two speed-regulated fans, one at the inlet and one at the outlet of the apparatus.

5 Claims, 2 Drawing Sheets

PROCESS FOR BONDING CELLULOSIC NONWOVENS WITH THERMOPLASTIC FIBERS USING INFRARED RADIATION

FIELD OF THE INVENTION

The present invention relates to activation and binding of cellulose fibers and similar fibers by means of thermoplastic fibers and heat. The basic technique is described in more detail in U.S. application Ser. No. 073,525 filed July 15, 1987, now abandoned, which application is incorporated herein by reference.

BACKGROUND OF INVENTION

A hot air oven was previously used for heat treatment of a mixture of cellulose fibers and thermoplastic fibers to melt the thermoplastic fibers and produce a binding action. The thermoplastic fibers must be heated to their melting point during a certain time period in order for satisfactory binding to take place. Such a thru-air heater is disclosed in, e.g., Swedish Patent Specification No. 199,787.

An alternative method for achieving the necessary heating is the use of heated rollers.

The use of infrared radiation for activating nonwoven cellulosic materials has indeed been suggested previously, but no practical method or apparatus has been designed for this purpose except the method and apparatus described in the above-mentioned U.S. patent application No. 073,525, now abandoned. However, certain improvements to this method and apparatus are needed to more effectively control the path of the air flow and the amount of air passing through the nonwoven material.

The present invention relates to a new method and a new apparatus that are specifically suitable for using the principles described in U.S. patent application No. 073,525, now abandoned.

Many napkin machines include a so-called "tissue portion". According to the present invention, the tissue material in the napkin is unnecessary and that entire portion of the machine can be replaced by the present invention. In this case, the length of the complete napkin machine is not increased. It is always an object to decrease the web length in such machines, since as a rule, the material in the machine must be discarded when the machine is stopped. The shorter the machine, the less discarded material there will be.

SUMMARY OF THE INVENTION

Thus, the present invention relates to a method of binding a nonwoven material by means of a binding agent requiring heat for activation of the binding agent, especially binding of cellulose fibers with a thermoplastic material, whereby the material is heated by means of an infrared radiation (IR) source and surface burning of the irradiated material is prevented by a weak air flow passing through the material. According to the invention, the air flow passes through the material in an inclined path directed from the edge of the infrared radiation source and toward the center thereof, by means of inclined guide plates or partitions.

Moreover, the entire amount of air through the material and the power supply to the infrared radiation sources are controlled by a control means, so that the amount of air is controlled in order to compensate for changes or variations in the surface temperature of the material having a short time duration, and the power supply is controlled in order to compensate for changes or variations having a long time duration. Preferably, the distance between each respective infrared radiation source and the material is also controlled by said control means in order to compensate for variations having a very long time duration.

The invention also relates to an apparatus comprising inclined guide plates or partitions to guide the air flow passing through the material in an inclined path directed from the edge of the infrared radiation source and toward the center thereof. Preferably, each infrared radiation source is surrounded by two sidewalls so that a space is formed between each sidewall and the radiation source for passage of the inlet air. The cross-sectional areas of said spaces are together approximately equal to the cross-sectional area of the opposite suction channel.

Alternatively, the cross-sectional area of the space positioned beyond the radiation source seen in the direction of movement of the material can be larger than the cross-sectional area of the space positioned before the radiation source.

Preferably, the supply of air is adapted to be controlled by means of two speed-controlled fans, one at the inlet of the apparatus and one at the outlet of the apparatus.

BRIEF DESCRIPTION OF THE DRAWINGS

The invention is described in more detail below by means of a preferred embodiment of the invention and by reference to the drawings.

Thus.

DETAILED DESCRIPTION OF PREFERRED EMBODIMENTS

Figure 1:
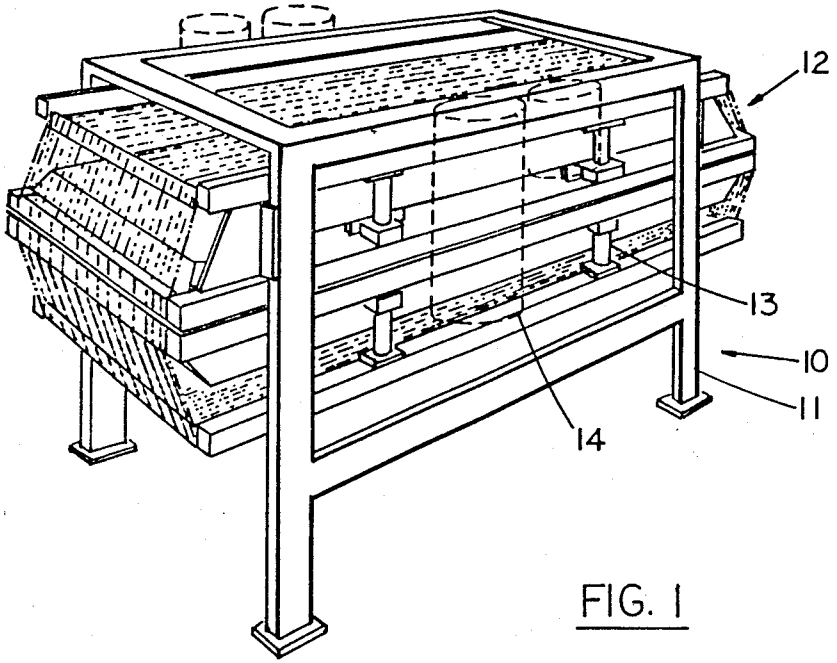
FIG. 1 is a perspective view of an apparatus according to the invention.

In FIG. 1, a binding apparatus according to the invention is shown in perspective. The apparatus comprises a stand (10) having four strong legs (11). In the stand (10), there are two cassettes (12) facing each other for enclosing the wire on which the nonwoven material has been formed.

The distance between the cassettes is adjustable for adaptation to the actual thickness of the nonwoven material. The adjustment is performed by several hydraulic cylinders (13) and is carried out in such a manner that the material is not squeezed by the cassettes.

Each cassette comprises several IR-radiation elements equally distributed along the length of the cassette. Between the IR-elements, there are spaces through which the cooling air can pass. The cooling air is controlled by means of partition walls or other suitable means so that the desired flow is achieved, as described in detail below in connection with FIG. 2.

The air is supplied to each cassette through large tubes (14). Air distribution members may be arranged inside the cassette for equal distribution of the air over the entire width or cross-section of the cassette, as described in more detail below.

The apparatus is provided with a safety system to shut off the apparatus as soon as there is a risk of fire. At the same time there is supplied an inert gas, such as halogen gas, whereby all risk of ignition is removed. Moreover, the two cassettes are separated so that the IR-elements are immediately removed from the nonwoven material. This safety device is fully automatically controlled by a fire detector of known type.

The apparatus shown in FIG. 1 is of the horizontal type in which the nonwoven material is moving in its normal horizontal path. This apparatus is preferred when there is sufficient space for inserting said apparatus in the path without too much rebuilding.

Figure 2:
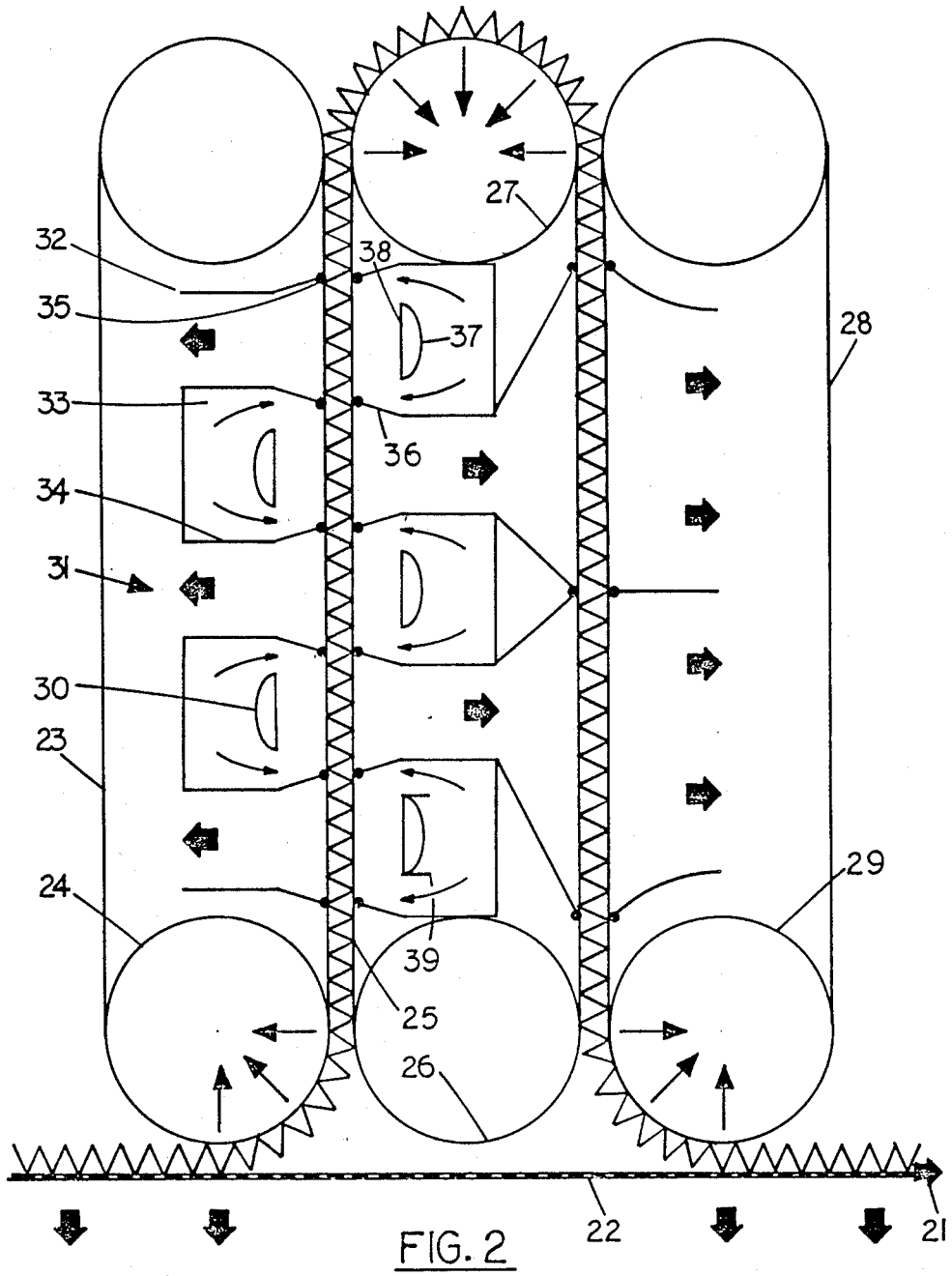
FIG. 2 is a cross-sectional view showing the principles according to the invention in connection with a vertical binding apparatus.

However, if there is no room for the apparatus if it is in a horizontal position, it is also possible to utilize the fact that industrial plants are often relatively high. In this case, the nonwoven material is conducted upwards in a U-shaped path, as is schematically shown in FIG. 2. The operation of the apparatus is, however, completely independent of horizontal or vertical orientation.

In FIG. 2, the normal wire direction is shown by the arrow (21), i.e., the wire (22) runs horizontally to the right in FIG. 2. The nonwoven material on the wire is transferred to a first vertical wire (23) by means of a first suction roller (24) in a conventional manner. During said vertical movement, the nonwoven material is positioned between the two wires, i.e., said vertical wire (23) and a second wire (25), which encircles a lower middle roller (26) and an upper middle roller (27), which also operates as a suction roller. After passing over the upper suction roller (27), the nonwoven material is gripped by a third wire (28) and is then transferred to the original wire (22) by means of a lower suction roller (29). Between the two middle rollers (26) and (27), there are several IR-elements (30) and corresponding suction stations (31) arranged in a cassette. In the embodiment shown, the IR-elements are only positioned along the upward path of movement of the material, but similar stations can of course also be positioned along the downward path of movement.

Said wires can be TEFLON®-coated glass fiber wires, controlled in a traditional manner.

The IR-elements (30) are spaced apart from one another, said space forming a suction channel (32) for the suction station (31). FIG. 2 shows that the suction channel (32) is narrower than the corresponding IR-element. Between each IR-element (30) and the corresponding side wall (34), there is formed a space (33), through which the inlet air flows. The cross-sectional area of said space is approximately equal to half the cross-sectional area of the suction channel, in order to have approximately the same air resistance as achieved in the suction channel (32).

It should be noted that the cooling air from the IR-elements is not used as cooling air for the nonwoven material, since it is too warm. Said cooling air for the IR-elements is exhausted to the surroundings through separate outlets, e.g., at the side edges of the IR-elements, as described in more detail below.

The IR-elements are positioned on both sides of the material, which gives the most favorable temperature distribution in the material. It is of course also possible to position the IR-elements on only one side of the material.

Each IR-element comprises one or several parallel radiation sources surrounded by reflectors (37) and is provided with a protective glass (38) of quartz on the side facing the nonwoven material. In the space between the quartz glass and the reflectors, input cooling air flows to the IR-elements by means of separate fans. The air flows over the surfaces inside the IR-element and passes out to the surroundings or to outlet channels at the ends of the elements, which possibly can extend outside the side edges of the wire. Consequently, the cooling air for the IR-elements has a circulation path of its own, but the inlet air may very well be taken from the complete inlet air or alternatively directly from the surroundings of the apparatus.

The IR-elements can be positioned so that the distance to the web can be adjusted as a function of various operating parameters. The adjustment can be provided by means of adjustment screws (39), which possibly can be driven by an electric motor to provide automatic adjustment. In this way, the distance to the web and thus also the distance to the nonwoven material, can be adjusted so that a suitable surface temperature is achieved at the edge of the IR-element.

Each IR-element is defined by two side walls (34) so that the above-mentioned space (33) is formed between the IR-element (30) and the corresponding side wall (34). The side wall is sealed on the side towards the wire with a suitable device, such as a rubber seal (35).

As can be seen in FIG. 2, the air flow through the wire will take place along an inclined path directed from the edge of the IR-element and toward the middle or center thereof. With this arrangement it is possible to position the IR-elements more closely to each other, which is necessary in order to obtain sufficient heating. It may be suitable to use an inclined guide plate (36) for directing the air flow in the correct direction. By means of this inclined guide plate, a short-circuit of the air flow is prevented to a certain degree.

The air flow is controlled by means of several speed regulated fans. It is preferred to use one fan at the inlet and one fan at the outlet. These fans ensure that the right amount of air is passed through the web.

It is of great importance that the air is equally distributed over the entire width of the nonwoven material. This can be attained by means of several known devices. Thus, it is possible to use guide walls and baffles or channels for guiding the air. Moreover, the air can be fed into special transverse tubes provided with radial outlet openings distributed over the length of the tube and thus over the width of the material. These outlet openings have such a cross-sectional area and such a distribution that a uniform air distribution takes place. Preferably, such distribution tubes extend inside the space above each IR-element for supply of air. Similar tubes may be arranged in the outlet section.

It may be desirable that a greater amount of air be passed through the web immediately behind an IR-element, since the cooling requirements are greatest at this position. This effect can be obtained by selecting the distance between the IR-element and the corresponding side wall (34) so that the distance behind the IR-element is greater than the distance in front of the element, seen in the direction of movement of the web.

The object of the heating of the nonwoven material is to heat the thermoplastic fibers as much as possible so that they perform their binding action to the desired extent. A suitable temperature is empirically determined for each type of thermoplastic fiber. A suitable temperature is at least 150° C. However, the temperature must not exceed 190° C., at which temperature cellulose fibers are deleteriously affected by the heat. It is of course of great importance that the temperature gradient in the material is as small as possible in order to obtain uniform binding properties in the material.

The IR-elements are of the type that product radiation having a short wave length that penetrates the material to a certain extent. However, most of the energy is still dissipated at the surface of the material. An air flow is passed through the material in order to counteract this energy concentration at the surface of the material. The air flow should be weak in order not to dislodge the cellulose fibers. The air flow cools the material and at the same time distributes the heat energy over the entire cross-section of the material.

For the purpose of illustration, it is mentioned that the power consumption of the IR-elements is about 288 kW for a specific material speed of 1,200 kg/hour, about 240 kW for 1,000 kg/hour and about 192 kW for 750 kW/hour. The power consumption seems to be approximately linearly proportional to the specific material speed but essentially independent of the linear speed of the material (m/sec) and the thickness of the material.

In order to be able to use as weak an air flow as possible, it is advisable to use air that is as cold as possible. Air at room temperature can be taken directly from the surroundings of the apparatus or outdoor air that has been filtered can be used. It is of course also possible to use air that has been cooled to a lower temperature. This air is heated relatively rapidly by the material and transports the energy accumulated in the material during its passage through the material. At the same time, the necessary cooling of the surface of the material is obtained.

According to the present invention, the apparatus is controlled so that the power consumption of the IR-elements, as well as the amount of air passing through the nonwoven material, are controlled by a control device. The control device is preferably an electronic device, e.g., a microprocessor. Input signals to the control device are the present values (is-values) or the different operation variables of the apparatus, such as the power consumption of each IR-element, the amount of air used per time unit, speed of the inlet and outlet fans, etc. Moreover, input signals are supplied from temperature sensors positioned along the nonwoven material on the wire.

The control device controls the power consumption of each IR-element and the speed of the fans according to a desired control algorithm. This control algorithm has properties such that the control of the amount of air has a short time constant while the control of the IR-elements has a long time constant. This means that a fortuitous increase in the surface temperature behind one of the IR-elements results in an increase in the amount of air to compensate for the increase in temperature. Only if the increase is lengthy does a decrease of the power supplied to the corresponding IR-element take place.

The control means can also comprise a means for controlling the distance between the wire and the corresponding IR-element by means of the above-mentioned screw device (39). This adjustment means has the same time constant as the power consumption and can be used alternatively. It is also possible to let this control means have a still longer time constant.

It is desirable to use as many temperature sensors as possible in order to control the operation accurately and safely. Thus, it would be desirable to use a first sensor at the site of the highest surface temperature immediately behind the IR-element when viewed in the direction of movement of the wire; a second sensor immediately in front of the IR-element where the temperature probably is lowest; and a third sensor at the other side opposite the IR-element. By means of these three sensors, monitoring will ensure that the surface temperature will not be too high and that the heat transport to the other surface of the material takes place to the desired extent for equal temperature distribution.

In the embodiment shown having five IR-elements, 15 sensors are required. Since reliable sensors are very expensive, it will probably be necessary to decrease the number of sensors and instead allow the microprocessor to compute the different temperatures according to a suitable mathematical model. Such a model should be produced in an empirical manner for different apparatus constructions. In such as embodiment it is sufficient to use two sensors or pyrometers, one at the middle and one at the end of the wire.

It is also possible to use cheaper and less reliable sensors at certain positions in order to lower the cost for the sensors.

The control device also performs other suitable functions in the apparatus, such as controlling the operation and alerting when dangerous conditions are imminent, e.g., when an IR-elemment is positioned too close to the wire. The control device can also store suitable adjustment parameters for different operation situations, e.g., distances, power consumption and air flow for the most common types of cellulose materials and thicknesses.

The invention has been described above by reference to preferred embodiments. A person skilled in the art realizes that such embodiments can be modified in many respects while still conforming to the principles of the invention. Such modifications are intended to be within the scope of the invention. The invention is limited only by the appended patent claims.

What I claim and desire to protect by Letters Patent is:

1. In a methhod for binding a thermoplastic material in a cellulosic fiber containing nonwoven material requiring heat for binding, the improvement comprising heating the nonwoven material, to a temperature of from at least 150° C. to 190° C. to melt the thermoplastic material, with an infrared radiation source having a power supply, while passing a flow of air through the nonwoven material in an inclined path directed from the edge of the infrared radiation source toward the center of the nonwoven material, so as to bind the nonwoven material without burning its surface or dislodging the cellulosic fibers.

2. The method of claim 1 wherein the air flow is controlled by means of inclined guide plates associated with each infrared radiation source.

3. The method of claim 1 wherein the amount of air passing through the material and the power supply to the infrared radiation sources are controlled by a control device so that the amount of air is controlled in order to compensate for variations in the surface temperature of the material having a short time duration, and the power supply is controlled in order to compensate for variations in the surface temperature of the material having a long time duration.

4. The method of claim 3 wherein the distance between the respective infrared radiation source and the material is controlled by said control device in order to compensate for variations in the surface temperature of the material having a very long time duration.

5. The method of claim 1 wherein the nonwoven material comprises a mixture of cellulosic fibers and a thermoplastic material.

* * * * *